US010036371B2

(12) United States Patent
Sundheim

(10) Patent No.: US 10,036,371 B2
(45) **Date of Patent: *Jul. 31, 2018**

(54) SCOTCH YOKE ARRANGEMENT

(71) Applicant: Gregory S. Sundheim, Englewood, CO (US)

(72) Inventor: Gregory S. Sundheim, Englewood, CO (US)

( * ) Notice: Subject to any disclaimer, the term of this patent is extended or adjusted under 35 U.S.C. 154(b) by 706 days.

This patent is subject to a terminal disclaimer.

(21) Appl. No.: 14/605,082

(22) Filed: Jan. 26, 2015

(65) Prior Publication Data

US 2015/0139839 A1 May 21, 2015

Related U.S. Application Data

(60) Continuation of application No. 13/018,059, filed on Jan. 31, 2011, now Pat. No. 8,939,042, which is a division of application No. 11/010,526, filed on Dec. 13, 2004, now Pat. No. 7,878,081.

(51) Int. Cl.

| | |
|---|---|
| ***F04B 9/04*** | (2006.01) |
| ***F04B 27/00*** | (2006.01) |
| ***F04B 35/06*** | (2006.01) |
| ***F04B 41/02*** | (2006.01) |

(Continued)

(52) U.S. Cl.

CPC ..... *F04B 9/04* (2013.01); *F04B 27/005* (2013.01); *F04B 35/06* (2013.01); *F04B 41/02* (2013.01); *F04B 53/00* (2013.01); *F25B 45/00* (2013.01); *F25B 2345/002* (2013.01);

(Continued)

(58) Field of Classification Search

CPC ..... F04B 27/00; F04B 27/005; F04B 27/02; F04B 1/02; F04B 1/00; F04B 13/00; F04B 25/00; F04B 29/00; F04B 3/00; F04B 35/00; F04B 5/00; F04B 7/00; F04B 9/00; F04B 49/22; F04B 53/08; F04B 53/00; F04B 9/042; F04B 9/045; F04B 9/047; F25B 45/00; F25B 2345/0051;

(Continued)

(56) References Cited

U.S. PATENT DOCUMENTS

| | | | | |
|---|---|---|---|---|
| 384,840 A * | 6/1888 | Hartley | B61G 1/40 213/186 |
| 734,595 A * | 7/1903 | Olin | F16H 21/36 74/50 |
| 1,664,492 A | 4/1928 | Smith et al. | |

(Continued)

*Primary Examiner* — Kenneth J Hansen

(74) *Attorney, Agent, or Firm* — W. Scott Carson

(57) ABSTRACT

A portable, refrigerant recovery unit for transferring refrigerant from a refrigeration system to a storage tank. The recovery unit includes two, opposed piston heads rigidly attached to respective piston rods that extend along a common fixed axis. The piston rods are rigidly attached to the yoke member of a scotch yoke arrangement. In operation, incoming refrigerant from the system is simultaneously and continuously directed to the opposing piston heads wherein the forces of the pressurized refrigerant on them counterbalance or neutralize one another. The recovery unit also has a cooling fan driven by the motor for driving the scotch yoke in which the fan is driven through a step up gearing arrangement. In operation, the drive shaft of the motor is rotated at a first rate and the driven shaft of the fan is driven at a greater rate (e.g., twice the first rate) by the step up gearing arrangement.

8 Claims, 14 Drawing Sheets

(51) Int. Cl.
*F04B 53/00* (2006.01)
*F25B 45/00* (2006.01)

(52) U.S. Cl.
CPC . *F25B 2345/006* (2013.01); *F25B 2345/0051* (2013.01); *Y10T 74/18256* (2015.01)

(58) Field of Classification Search
CPC ..... F25B 2345/002; F25B 2345/006; Y01T 74/18256
USPC ..... 417/534, 415
See application file for complete search history.

(56) References Cited

U.S. PATENT DOCUMENTS 2,620,965 A * 12/1952 Miller ..... A01G 3/00 417/231
3,067,624 A 12/1962 Norton et al.
3,670,190 A * 6/1972 Goebel ..... H02K 9/06 310/60 R
3,834,840 A * 9/1974 Hartley ..... F04B 9/045 417/535
3,839,946 A 10/1974 Paget
4,074,530 A * 2/1978 Polster ..... F01B 1/08 60/518
4,132,510 A * 1/1979 Takahashi ..... B26D 7/086 417/534
4,408,968 A * 10/1983 Inagaki ..... F04C 18/3441 418/15
4,523,897 A * 6/1985 Lower ..... F01C 21/0809 417/244
5,092,185 A * 3/1992 Zornes ..... F16C 19/40 74/44
5,943,987 A * 8/1999 Fischer ..... F01B 9/026 123/197.4
6,431,760 B1 8/2002 Nawamoto et al.
6,513,982 B2 2/2003 Boyd et al.
2006/0073033 A1* 4/2006 Sundheim ..... F04B 17/06 417/410.3
2008/0050257 A1* 2/2008 Kawabata ..... F04C 29/04 418/9

* cited by examiner

SCOTCH YOKE ARRANGEMENT

RELATED APPLICATIONS

This application is a continuation of U.S. patent application Ser. No. 13/018,059 filed Jan. 31, 2011, now U.S. Pat. No. 8,939,042 issued Jan. 7, 2015, which is a division of U.S. patent application Ser. No. 11/010,526 filed Dec. 13, 2004, now U.S. Pat. No. 7,878,081 issued Feb. 1, 2011, which are all incorporated herein by reference.

BACKGROUND OF THE INVENTION

1. Field of the Invention

This invention relates to the field of portable, refrigerant recovery units.

2. Discussion of the Background

Portable, refrigerant recovery units are primarily used to transfer refrigerant from a refrigeration system to a storage tank. In this manner, the refrigerant can be removed from the system and captured in the tank without undesirably escaping into the atmosphere. Needed repairs or other service can then be performed on the system.

Such recovery units face a number of problems in making the transfer of the refrigerant to the storage tank. In particular, the initial pressures of the refrigerant in the system can be quite high (e.g., 100-300 psi or more). These pressures can exert significant forces on the components of the unit including the pistons and drive mechanism. In some cases, the initial force may even be high enough to overpower the drive mechanism of the recovery unit and prevent it from even starting. In nearly all cases, the forces generated by the incoming pressurized refrigerant during at least the early cycles of the recovery operation are quite substantial and can be exerted in impulses or jolts. These forces can easily damage and wear the components of the unit if not properly handled.

In some prior designs, attempts have been made to minimize the forces exerted on the piston by exposing both sides of the head of the piston to the pressurized refrigerant. However, nearly all of these prior designs result in exposing not only the underside of the piston head to the refrigerant but also the piston rod and drive mechanism (e.g., crankshaft). Because the refrigerant typically has oil and other contaminants (e.g., fine metal particles) in it, the exposed piston rod, crankshaft, other parts of the recovery unit can become prematurely worn and damaged, particularly at their seals and bearings.

In other prior arrangements that do not expose these parts of the unit to the refrigerant, efforts have been tried to minimize the wear and damage to the drive mechanism (e.g., crankshaft bearings) from the refrigerant forces by operating another piston along the crankshaft at 180 degrees out of phase. However, these arrangements still drive the piston rods eccentrically about the axis of the crankshaft and out of alignment with each other. In most cases, they also pivotally mount the piston heads to the piston rods (e.g., with wrist pins). Although the forces of the pressurized refrigerant on the crankshaft are somewhat offset in such arrangements, the eccentrically mounted and unaligned piston rods still apply unbalanced stresses to the crankshaft. Additionally, the forces of the pressurized refrigerant are still borne by the pivot arrangement between the head and rod of each piston. The pivot arrangement in particular can then wear leading to irregular operation of the piston and seal leakage. Eventually, the pivot arrangement may even fail altogether.

With these and other problems in mind, the present invention was developed.

SUMMARY OF THE INVENTION

This invention involves a portable, refrigerant recovery unit for transferring refrigerant from a refrigeration system to a storage tank. The recovery unit includes two, opposed piston heads rigidly attached to respective piston rods that extend along a common fixed axis. The piston rods in turn are rigidly attached to the yoke member of a scotch yoke arrangement. The scotch yoke arrangement translates rotational motion from a driving mechanism into reciprocal movement of the yoke member and rigidly attached piston rods and piston heads along the common fixed axis.

In operation, incoming refrigerant from the system is simultaneously and continuously directed to the opposing piston heads wherein the forces of the pressurized refrigerant on them counterbalance or neutralize one another. The drive mechanism of the unit can then reciprocate the pistons independently of the size of any forces generated on them by the incoming refrigerant. The flow path of the refrigerant is also isolated from the piston rods and drive mechanism to avoid any exposure to any contaminants in the refrigerant. Details of the scotch yoke arrangement are also disclosed including a two-piece slide mechanism mounted about a cylindrical crank pin. A single piston embodiment is additionally disclosed which is reciprocally driven by a scotch yoke arrangement and has structure to offset at least part of any force generated on the piston head by the incoming, pressurized refrigerant. The recovery unit also has a cooling fan driven by the motor for driving the scotch yoke arrangement in which the fan is driven through a step up gearing arrangement. In operation, the drive shaft of the motor is rotated at a first rate of revolution and the driven shaft of the fan is driven at a greater rate (e.g., twice the first rate) by the step up gearing arrangement

DETAILED DESCRIPTION OF THE INVENTION

Figure 1:
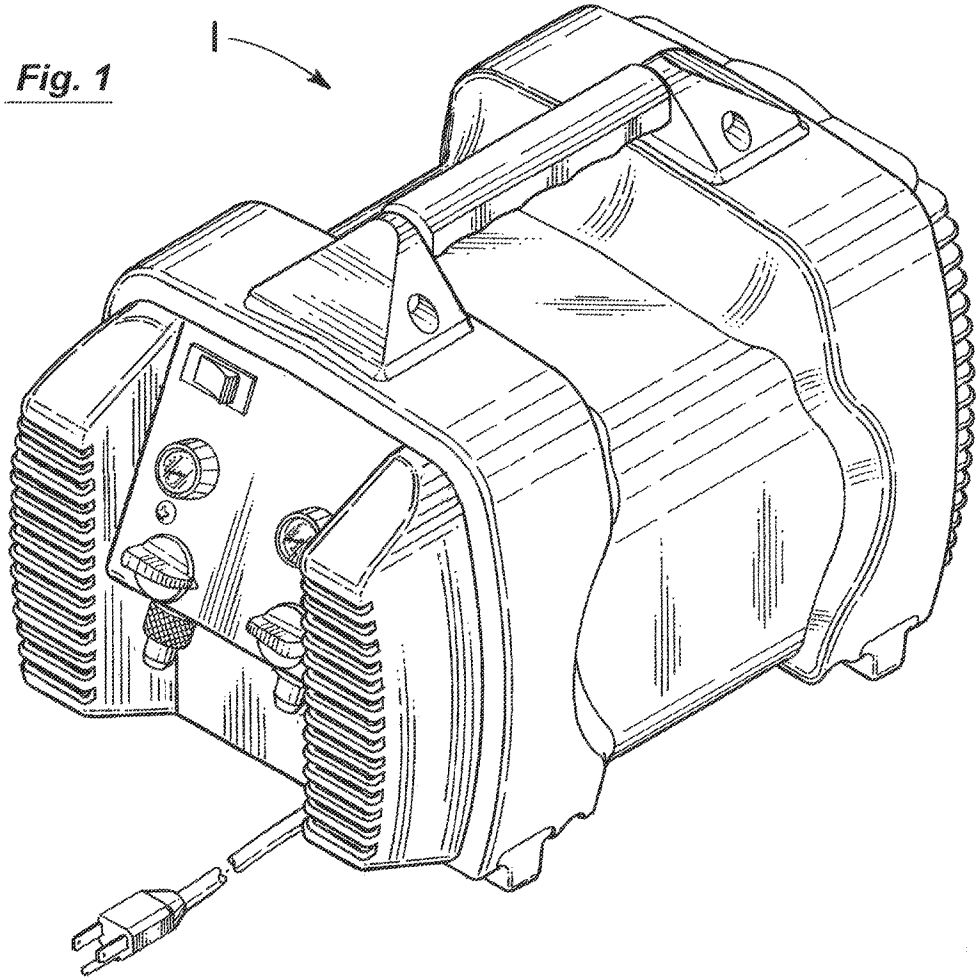
FIG. 1 is a perspective view of the portable, refrigerant recovery unit of the present invention.
Figure 2:
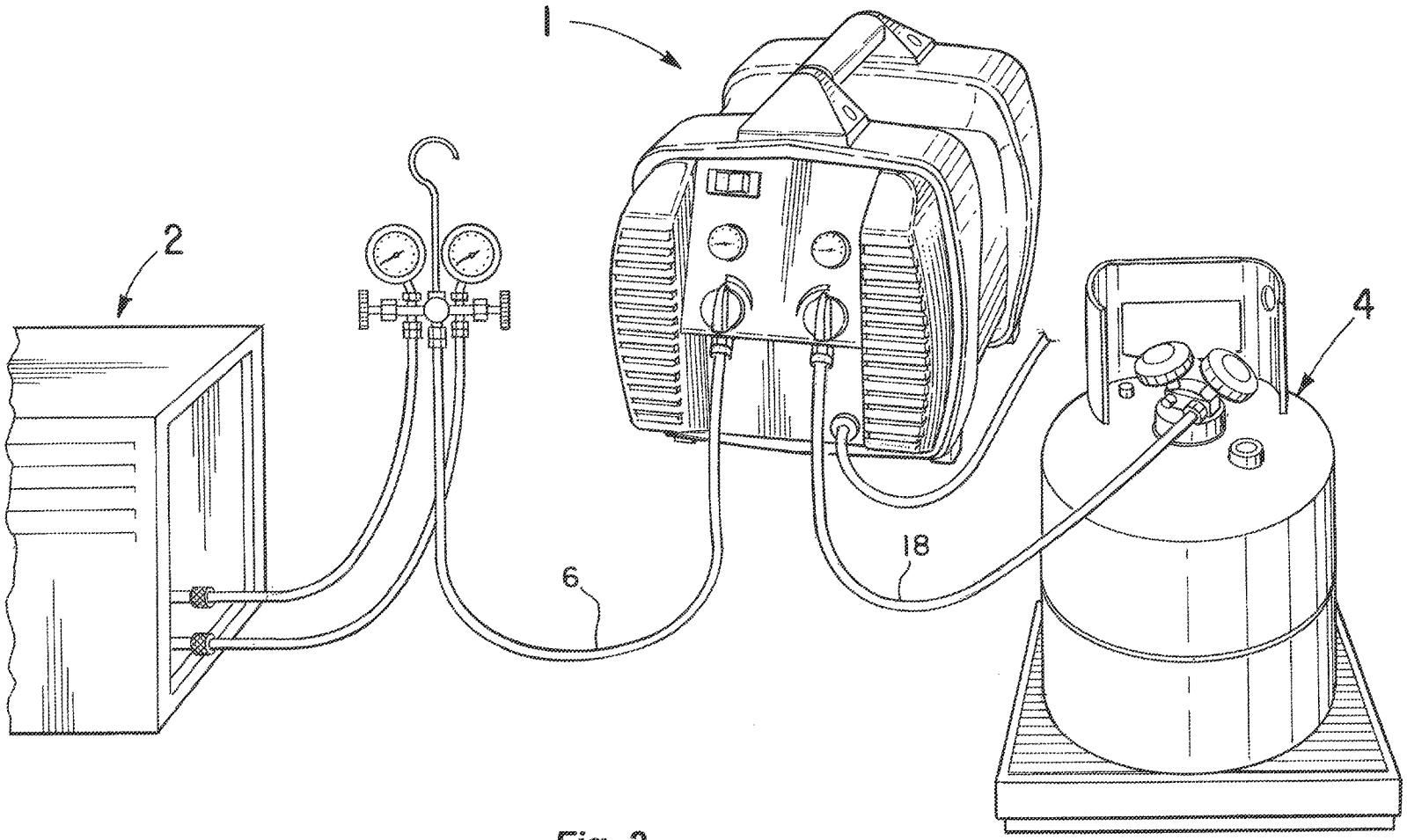
FIG. 2 illustrates a typical operating arrangement in which the recovery unit is used to transfer refrigerant from a refrigeration system to a storage tank.
Figure 3:
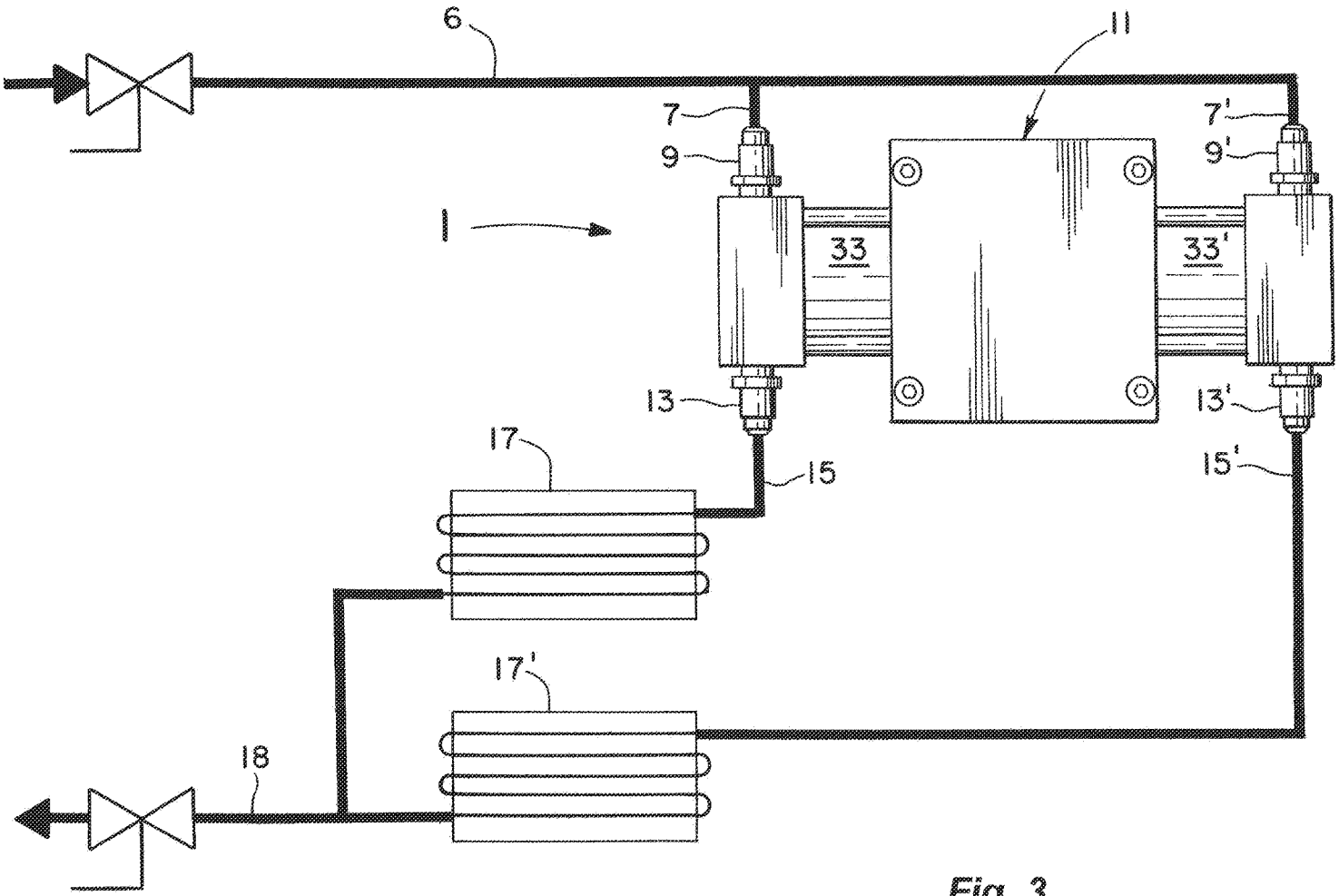
FIG. 3 is a schematic showing of part of the the operating arrangement of FIG. 2.

FIG. 1 illustrates the portable, refrigerant recovery unit 1 of the present invention. In a typical operating arrangement as shown in FIG. 2, the unit 1 is used to transfer refrigerant from the refrigeration system 2 to the storage tank 4. This basic operating arrangement is schematically illustrated in FIG. 3. In it, refrigerant from the recovery system 2 of FIG. 2 is being delivered through the line 6 (FIGS. 2 and 3) to the incoming lines 7, 7' of the recovery unit 1 (FIG. 3). The lines 7,7' as illustrated are respectively connected to the inlets 9, 9' of the compressor 11 of the recovery unit 1. From the compressor 11 in FIG. 3, the refrigerant is passed through outlets 13, 13' to the lines 15, 15' on which condensers 17, 17' are mounted and then through line 18 to the storage tank 4 of FIG. 2.

Figure 4:
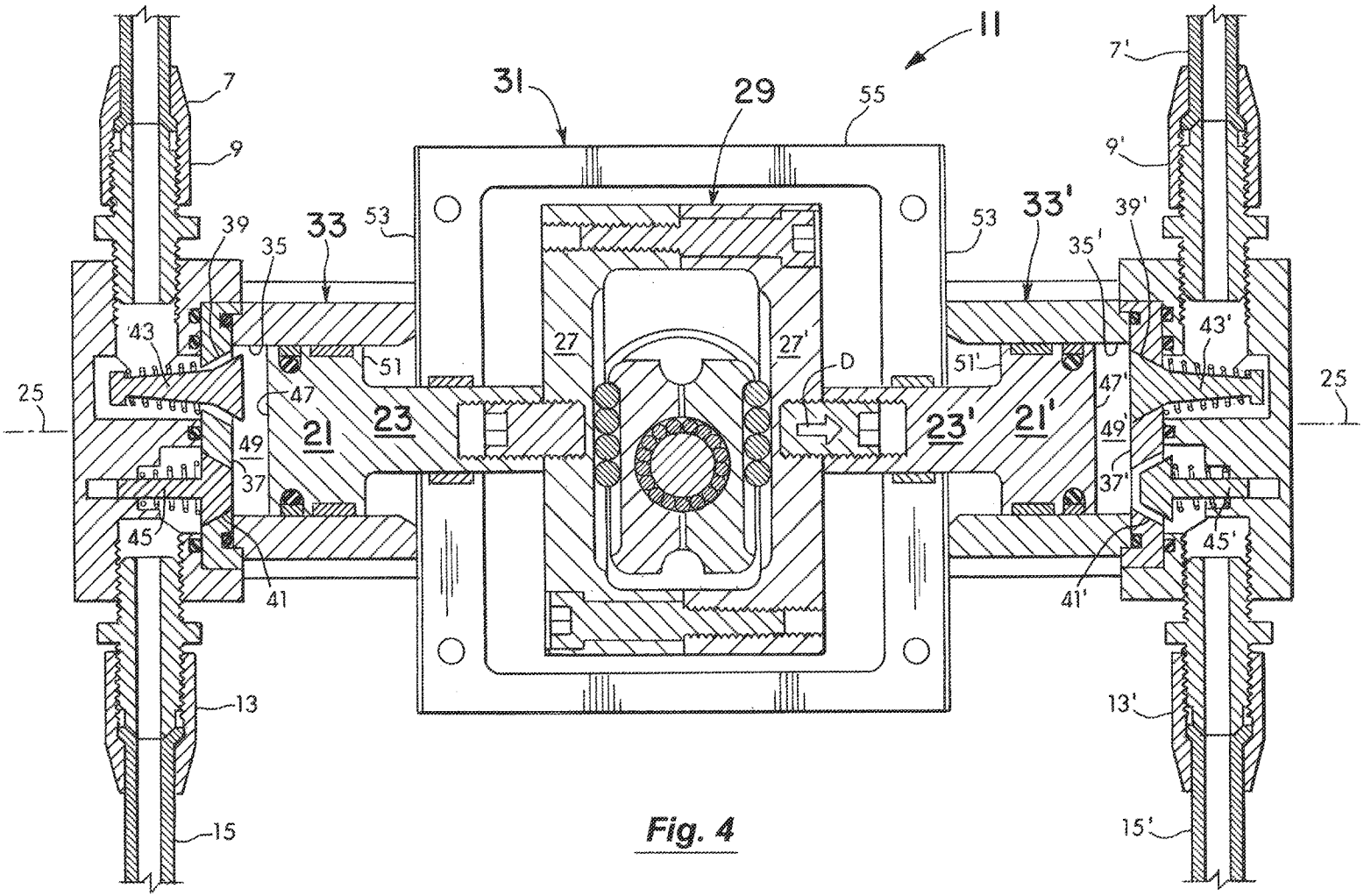
FIGS. 4-6 are sequential views of the operation of the opposing pistons of the compressor of the present invention.

The compressor 11 of the recovery unit 1 as best seen in FIG. 4 has opposing piston heads 21,21' respectively rigidly attached to piston rods 23,23'. The piston rods 23,23' in turn extend along a common fixed axis 25 and are rigidly attached to the side pieces 27,27' of the yoke member 29. The piston rods 23,23' in FIG. 4 extend in opposite directions from the yoke side pieces 27,27' along the common fixed axis 25. The yoke member 29 as explained in more detail below is part of a scotch yoke arrangement 31. The scotch yoke arrangement 31 in this regard serves to translate rotational motion from a driving mechanism discussed later into reciprocal movement of the yoke member 29 and rigidly attached piston rods 23,23' and piston heads 21,21' along the common fixed axis 25.

Each piston head 21,21' in FIG. 4 is slidably and sealingly received in a cylinder 33,33' having an inner, cylindrical side wall 35,35' and an end wall 37,37'. As shown in FIG. 4, each end wall 37,37' has an inlet 39,39' and outlet 41,41' with respective one-way valves 43,43' and 45,45' therein. Each piston head 21,21' in turn has an outer surface 47,47' opposing the end wall 37,37' to define a chamber 49,49' with the end wall 37,37' and side wall 35,35' of each chamber 49,49'. These substantially mirror-image, twin arrangements are preferably identical in size and in particular, the circular areas of the outer surfaces 47,47' of the piston heads 21,21' are preferably the same (e.g., about one inch in diameter).

Figure 5:
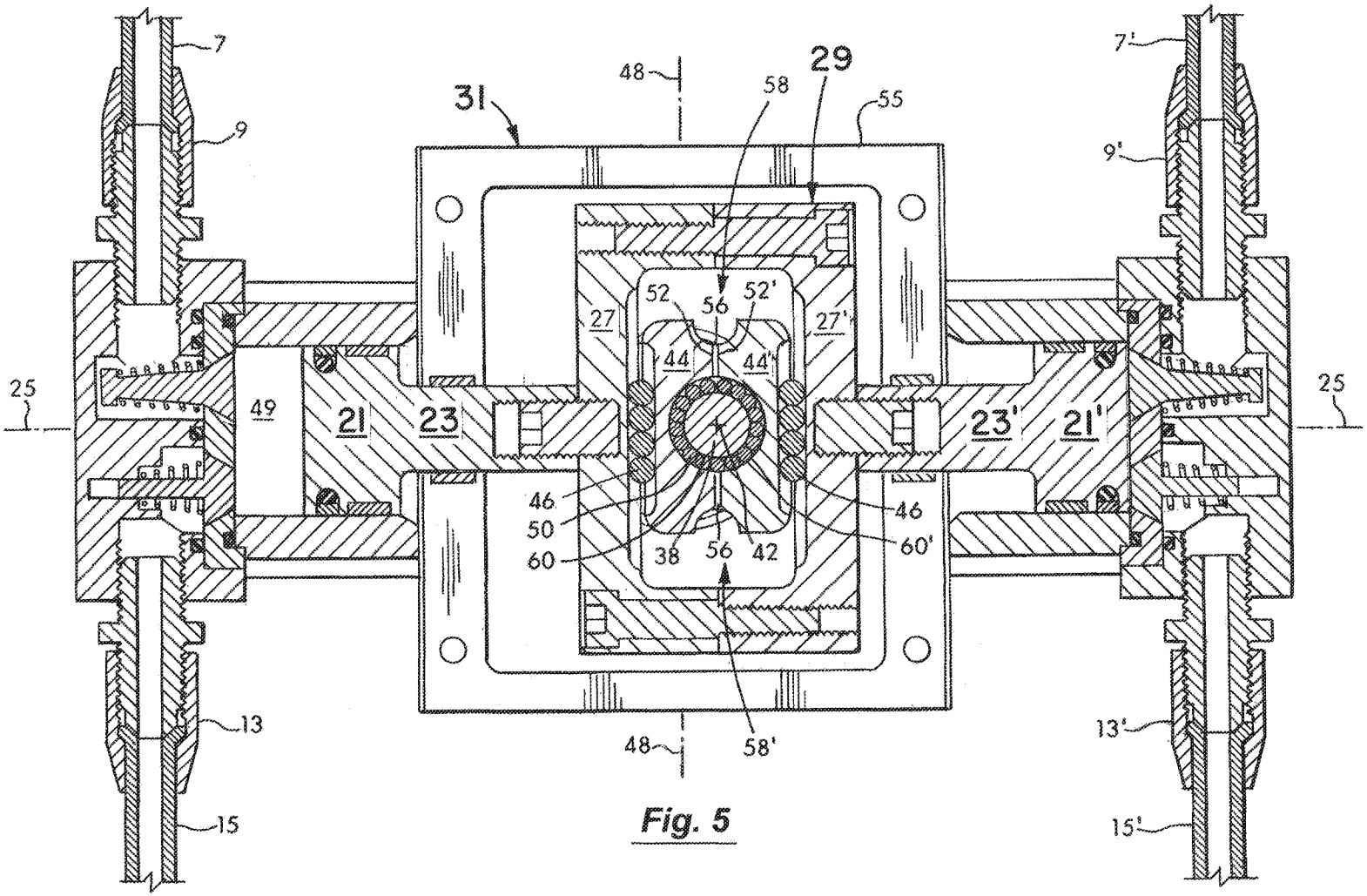
Figure 6:
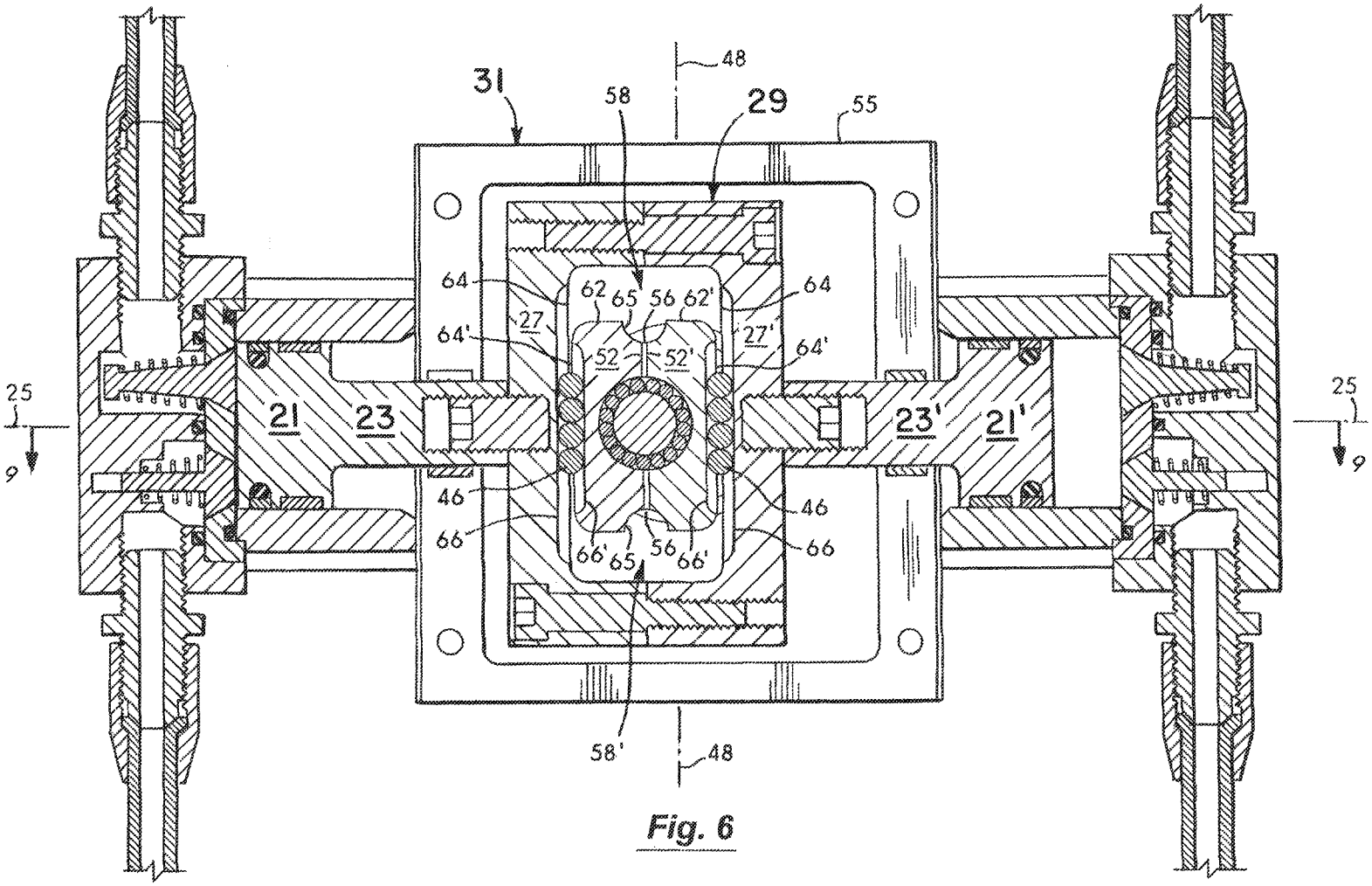

The reciprocating piston rods 23,23' move the respective piston heads 21,21' along the common fixed axis 25 relative to the cylinder end walls 37,37' between first and second positions. The piston heads 21,21' in this regard oppose one another and are operated 180 degrees out of phase with each other. More specifically, as the piston 21 of FIG. 4 for example is moved to its first position (see FIG. 5), the volume of the chamber 49 is expanded to receive refrigerant from the refrigeration system 2 of FIG. 2 through the common line 6 (FIGS. 2 and 3) and incoming line 7. At the same time, the opposing piston head 21' is being moved to its second position of FIG. 5 to contract the volume of the chamber 49' of FIG. 4 to drive the refrigerant out of the chamber 49' into line 15'. The process is then reversed to move the aligned piston heads 21,21' to the position of FIG. 6. In the contracted position of each piston head (e.g., see 21' in FIG. 5), the substantially parallel piston surface 47' and the end wall 37' of FIG. 4 preferably abut and are flush with one another for maximum compression (e.g., 300:1 or more). As shown in FIGS. 4-6, the piston heads 21,21' and piston rods 23,23' during their movement between the respective first and second positions are constrained to move symmetrically along the common fixed axis 25.

Figure 7:
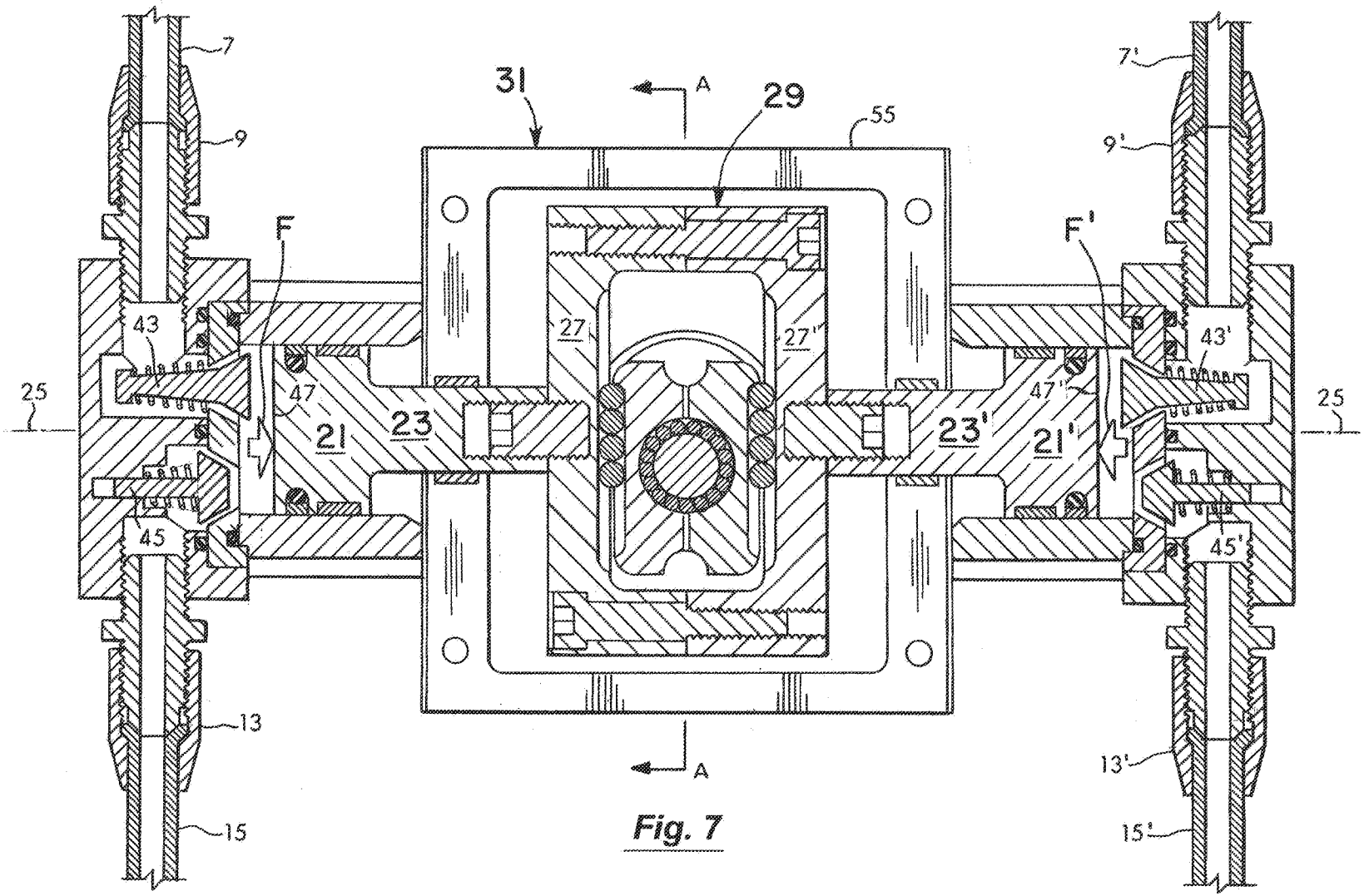
FIG. 7 is a view of the pistons at the outset of a hookup to the refrigeration system of FIG. 2 in which the pressures of the refrigeration system and storage tank are being equalized prior to the start up of the compressor.

In operation, the refrigerant in the refrigeration system 2 to be recovered is normally at an initial pressure above atmospheric. In most cases, the pressure of the refrigerant will be well above atmospheric (100-300 psi or more). In contrast, the initial pressure in the storage tank 4 can vary from below atmospheric to above atmospheric depending upon how nearly empty or full the tank 4 is. As for example, the storage tank 4 prior to the start of a recovery operation may have been evacuated below atmospheric to remove air so as not to contaminate the refrigerant to be recovered. On the other hand and if the storage tank 4 is partially full (e.g., from a previous operation), the tank 4 may be at a pressure above atmospheric or even above the pressure of the refrigerant to be recovered from the refrigeration system 2 of FIG. 2. To the extent the initial pressure of the storage tank 4 is above the initial pressure of the refrigeration system 2, the outlet valves 45,45' of the chambers 49,49 in FIG. 4 will remain closed. However, to the extend the initial pressure of the storage tank 4 at hookup is below the pressure of the refrigerant in the refrigeration system 2, both pairs of inlet and outlet valves 43,45 and 43',45' will be opened as shown in FIG. 7. Refrigerant will then flow uninhibited from the refrigeration system 2 to the storage tank 4 until the pressures equalize and the valves 43,43',45,45' close. Thereafter, the operation of the compressor 11 of the recovery unit 1 as illustrated in FIGS. 4-6 will be needed to transfer refrigerant from the refrigeration system 2 to the storage tank 4.

During the initial cycles of operation of the compressor 11 as indicated above, the refrigerant in the refrigeration system 2 normally is still above atmospheric. In most cases as also previously discussed, the incoming refrigerant will be well above atmospheric (e.g., 100-300 psi or more). Such high pressures if not properly handled can easily generate forces great enough to damage the components of the compressor 11 and lead to premature failure. In particular and if not properly handled, the initial force at hookup may even be high enough to overpower the driving mechanism of the compressor to the point that it cannot be started. To prevent this as explained in more detail below, the piston heads 21,21' of the present invention are mounted in an opposing configuration wherein the forces generated on them by the incoming, pressurized refrigerant are counterbalanced or neutralized. Start up problems are essentially eliminated and any damage and wear due to the high forces of the pressurized refrigerant during the initial cycles of operation are greatly reduced.

More specifically and looking first at only the half of FIG. 7 to the left of line A-A, the incoming refrigerant in line 7 of FIG. 7 is normally at pressures well above atmospheric (e.g., up to 100-300 psi or more). Such pressures will open the inlet valve 43 and instantaneously exert a force $\underline{F}$ on the outer surface 47 of the piston head 21. This force $\underline{F}$ can be very significant and remain so during the initial cycles of the recovery operation until the pressure of the incoming refrigerant is greatly reduced (e.g., to 50-75 psi or lower). The initial size of the force $\underline{F}$ as discussed above may even be high enough to overpower the drive mechanism of the compressor 11 (were only the left piston head 21 and piston rod 23 of FIG. 7 present) and prevent the compressor 11 from starting. Initially and until the pressure of the incoming refrigerant in such a design is significantly reduced, the applied force $\underline{F}$ (which may even be exerted in impulses or jolts) on the piston head 21, piston rod 23, and the drive mechanism for the compressor 11 could easily lead to premature wearing and even failure. This is particularly true if the high pressure refrigerant is in a liquid phase. Eventually, the size of the force $\underline{F}$ would be reduced with each cycle of the piston head 21 as the pressure of the incoming refrigerant falls and the refrigerant is in a gas or vapor phase. However, until the refrigerant pressure (regardless of phase) in such a design is significantly reduced (e.g., to 50-75 psi or lower), each force F during each reciprocating cycle of the piston head 21 could damage and strain the components of the compressor 11. Again, this is describing the case were only the left piston head 21 and piston rod 23 of FIG. 7 present.

In this light, the design of the present invention was developed. With it, the previously unbalanced force F on the piston head 21 on the left half of FIG. 7 at the outset and subsequent cyclic operation of the recovery unit 1 is counterbalanced or neutralized by an opposing force F' on the opposite piston head 21'. The potentially damaging effect of the incoming force F is thereby essentially eliminated. This is particularly true because the intermediate structure including the piston heads 21,21' and piston rods 23,23 are axially aligned along 25 and rigidly attached to one another. Further, the drive mechanism for the compressor 11 only needs to then provide a differential force D (see FIG. 4) to reciprocate the piston heads 21,21' to compress the refrigerant in the respective chambers 49,49' and drive the refrigerant into the storage tank 4. In doing so, the drive mechanism of the compressor 11 does not have to overcome or compensate for the forces F,F' on the piston heads 21,21' in FIG. 7 as they counterbalance or neutralize one another. The drive mechanism for the compressor 11 can thus be designed to provide a maximum pressure (e.g., 550 psi or more in the chambers 49,49') without having to consider or compensate for any effects of the incoming, refrigerant forces F,F'. In most cases, the compressor 11 can actually generate much higher pressures (750-1500 psi or more) but the operation of the unit 1 is normally limited to a lower pressure (e.g., 550 psi) for safety to protect the storage tank 4.

The isolation of the drive mechanism from the forces F, F' is particularly important in the application of the present invention because the operating fluid as discussed above is two phase refrigerant. Consequently and usually unpredictably, the incoming refrigerant at any time may change phases and widely vary the forces F,F' on the piston heads 21,21'. However, due to the counterbalancing design of the present invention, the forces F,F' at any such time on the piston heads 21,21 are neutralized along the common axis 25. The drive mechanism for the compressor 11 is then essentially unaffected by the forces F,F' and/or the conditions (e.g., pressure, temperature, phase) of the incoming refrigerant. The differential force D provided by the compressor 11 in FIG. 4 will therefore be enough to move the twin piston heads 21,21' repeatedly through their cycles to transfer the refrigerant (regardless of its phase or state from the refrigeration system 2 to the storage tank 4.

Although the counterbalancing design of the present invention isolates the differential force D from the forces F, F', the drive mechanism including the piston rods 23,23' of the compressor 11 and the components of the scotch yoke arrangement 31 must still be fairly structurally substantial. This is the case because the forces F,F' (particularly during the initial operational cycles of the unit 1) must still be borne by the opposing components of the compressor 11. This includes the axially aligned piston heads 21,21' and piston rods 23,23' as well as the yoke member 29 of the scotch yoke arrangement 31. In this regard, it is again noted that these aligned and opposed members are rigidly attached and fixed to one another. This further enhances their ability to carry large loads including from the forces F,F' without the undue damage and wear that might occur were these components not aligned and fixed relative to each other and not constrained to move symmetrically along the common fixed axis 25.

In operation, the compressor 11 as shown in FIG. 4 provides the differential force D in a direction (e.g., to the right in FIG. 4) along the common fixed axis 25. Only the force D is illustrated in FIG. 4 for clarity because the opposing forces F,F' of FIG. 7 as discussed above cancel one another out. However, in driving the compressor 11 to the right in FIG. 4, the differential force D does combine with the force F of the pressurized refrigerant on the piston head 21 in that same direction to create a second force (F+D). This second force is then greater than the opposing first force F' on the opposing piston head 21'. The opposing piston head 21' is thereby driven to the right in FIG. 4 toward its contracted position of FIG. 5.

Stated another way, the incoming refrigerant at pressures above atmospheric in the lines 7,7' to the chambers 49,49' exerts first, opposing forces F,F' on the outer surfaces 47,47' of the piston heads 21,21'. These opposing forces F,F' are directed along the common fixed axis 25. During the operating cycle as for example when piston head 21 is moved from its contracted position of FIG. 6 back to its expanded position of FIG. 5, the differential force D supplied by the scotch yoke arrangement 31 adds to the force F on the piston head 21. This in turn serves to move the other piston head 21' to its contracted position of FIG. 5. The cycle is then repeated and is largely independent of any changing conditions (pressure, temperature, phase) in the refrigerant or the forces F,F'.

To aid in maintaining the forces F,F' essentially the same, the incoming lines 7,7' as indicated above (FIG. 3) are in fluid communication with each other and with the refrigerant in the line 6 from the refrigeration system 2 of FIG. 2. In this manner and even though the pressure of the refrigerant varies over time, it will always be the same in the incoming lines 7,7'. Consequently, the inlet valves 43,43' of the chambers 49,49' upstream of the inlets 39,39' are simultaneously and continuously exposed to the same refrigerant pressure. The opposing forces F,F' generated by the incoming, pressurized refrigerant on the outer surfaces 47,47' of the opposing piston heads 21,21' are then essentially always the same. It is additionally noted that the outgoing lines 15, 15' in FIG. 2 downstream of the outlet valves 45,45' in each chamber outlet 41,41' are also in fluid communication with each other and the storage tank 4 through line 18.

Figure 8:
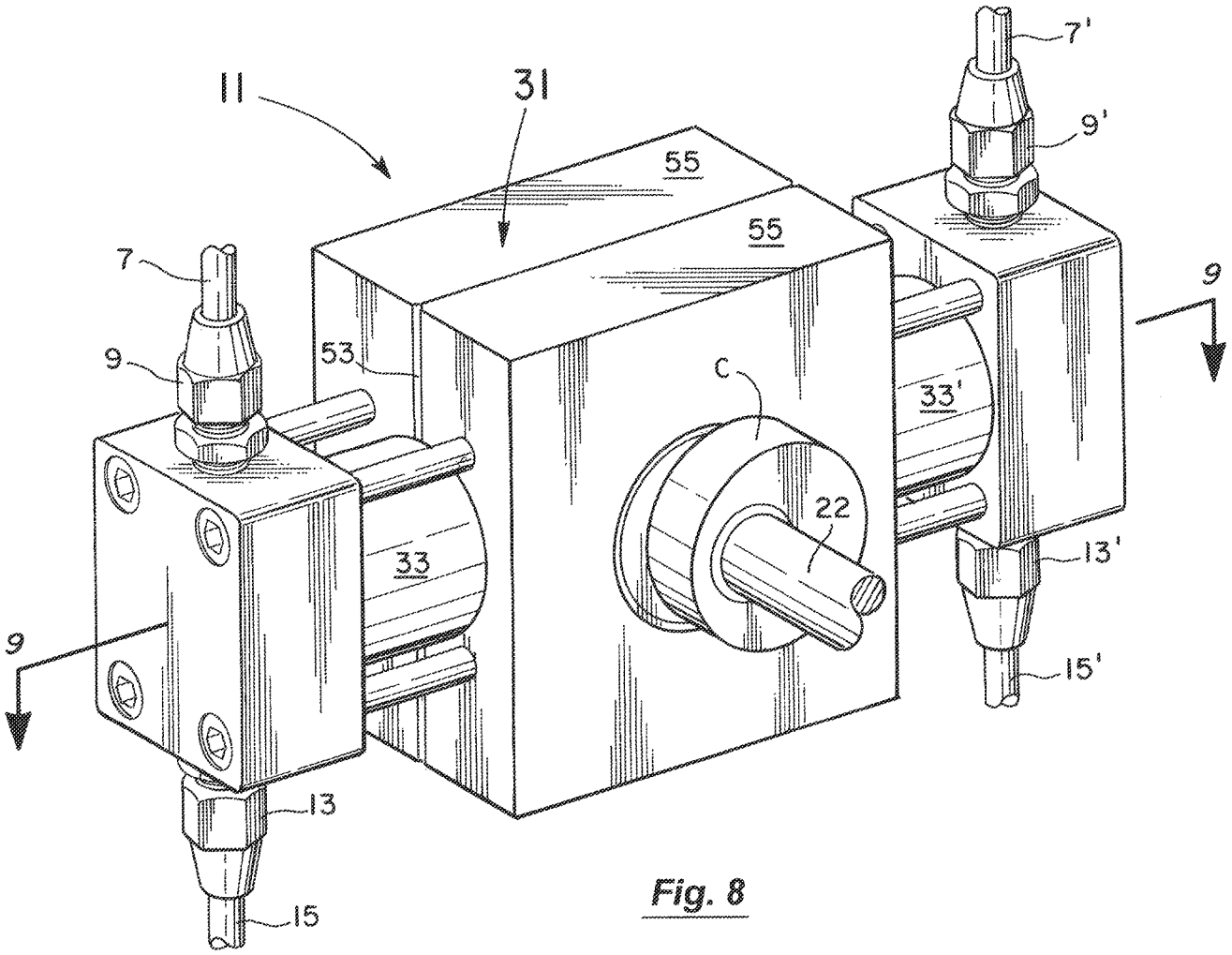
FIG. 8 is a perspective view of the compressor.

With the counterbalancing design of the present invention, the only areas exposed to the refrigerant and its possible contaminants (e.g., oil, fine metal particles) are the chambers 49,49' and the flow paths to and from them. In particular, the undersides or bottoms 51,51' of the piston heads 21,21' in FIG. 4 are not exposed to the refrigerant nor is the drive mechanism including the piston rods 23,23' and the components of the scotch yoke arrangement 31. These elements and the other components of the recovery unit 1 are then isolated from exposure to the incoming refrigerant and the refrigerant is confined to the chambers 49,49' of the unit 1 and their incoming 7,7' and outgoing 15, 15' lines. The undersides or bottoms 51,51' of the piston heads 21,21' in this regard are preferably open to ambient air through the beveled or V-shaped gap 53 (see FIGS. 4 and 8) between the each cylinder 33,33' and the housing members 55 of the scotch yoke arrangement 31.

Figure 9:
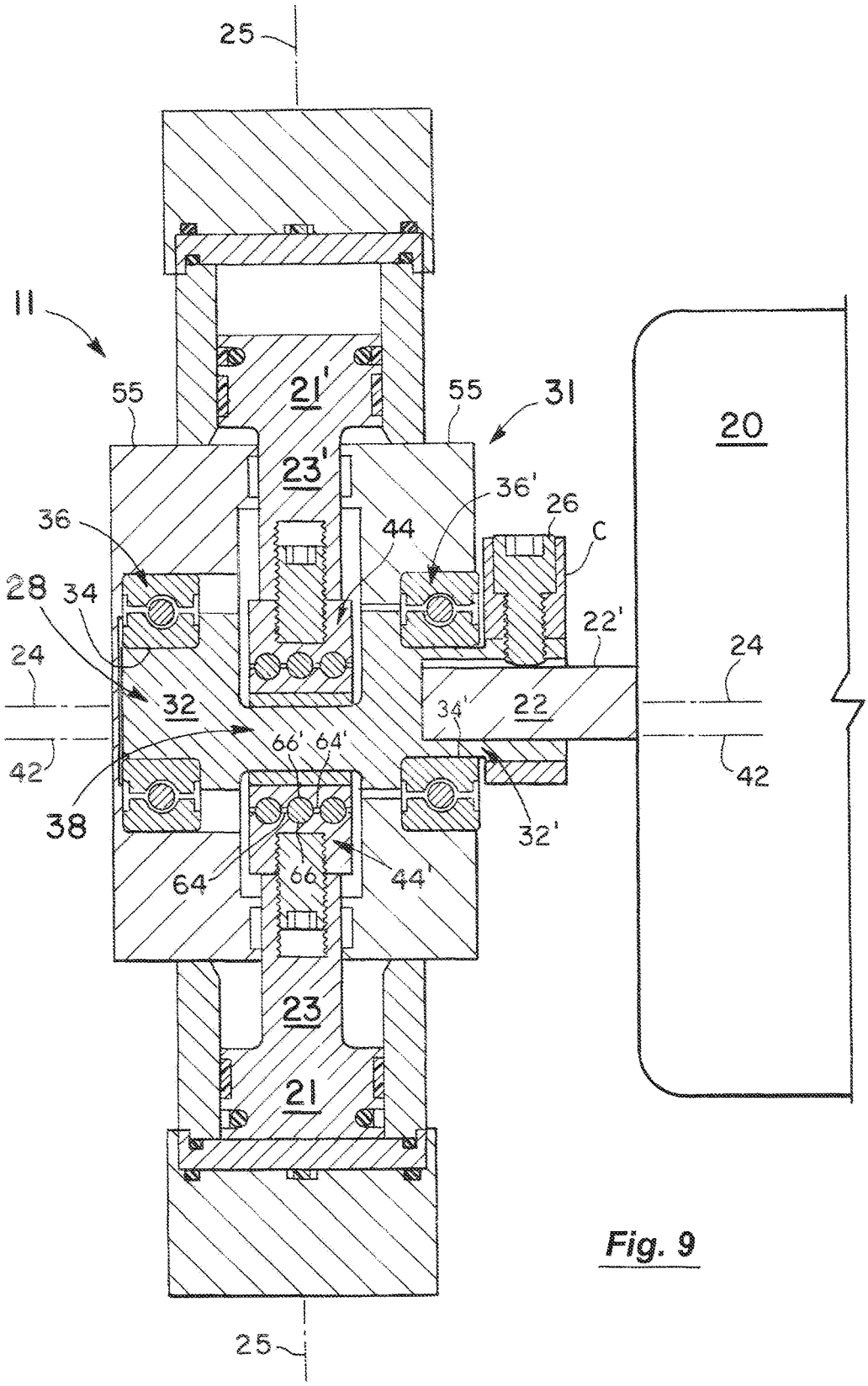
FIG. 9 is a view taken along line 9-9 of FIGS. 6 and 8.
Figure 10:
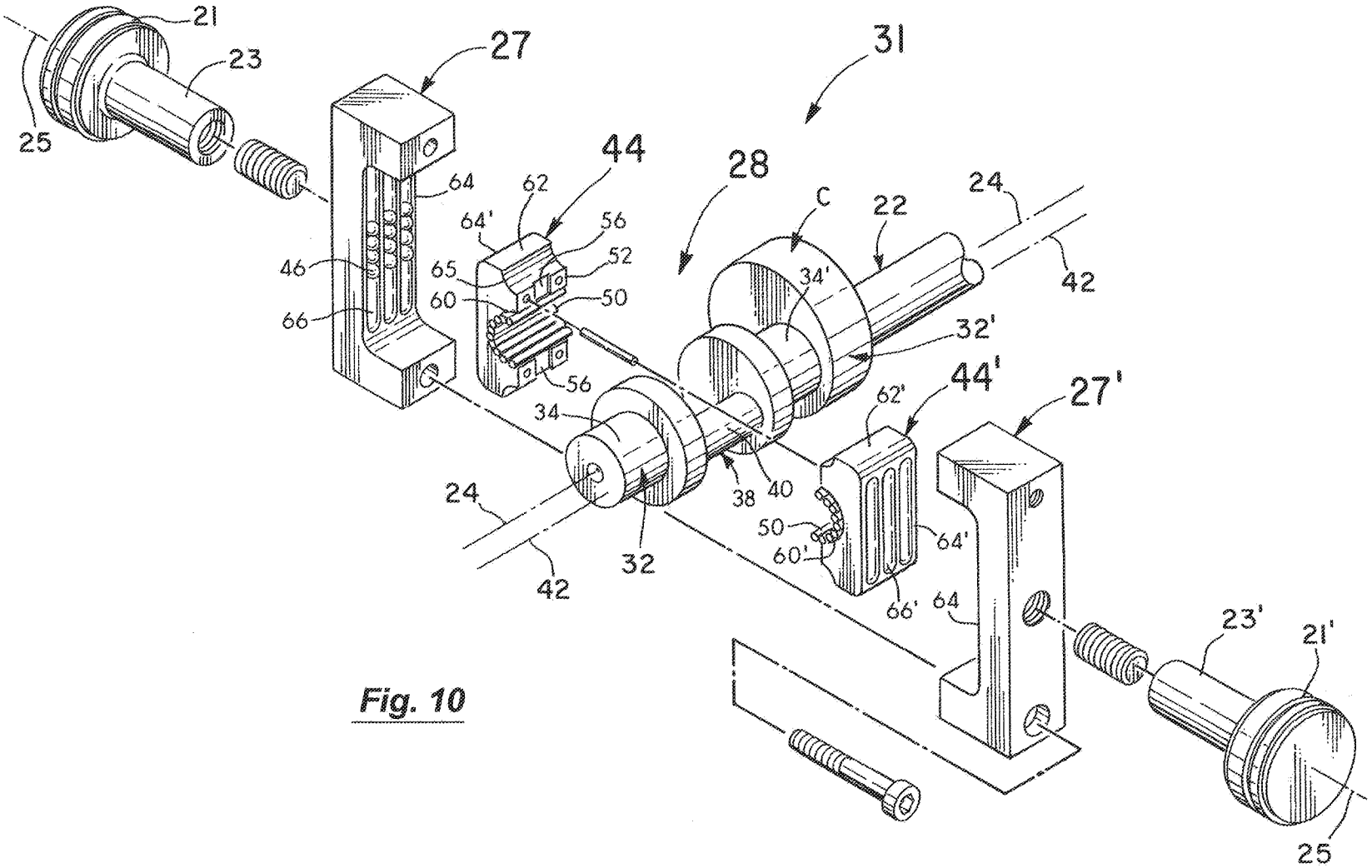
FIG. 10 is an exploded view of the drive mechanism for the compressor.

Referring to FIGS. 6 and 9, the drive mechanism for the compressor 11 includes the motor 20 (FIG. 9) which rotates the shaft 22 about the axis 24. The motor shaft 22 has a flattened upper portion 22' and is attached adjacent the counterweight C by a set screw 26 to the crankshaft 28 of the scotch yoke arrangement 31. The crankshaft 28 (see also FIG. 10) has spaced-apart bearing portions 32,32' with cylindrical surfaces 34,34' extending symmetrically about the rotational axis 24 within the race bearings 36,36' of FIG. 9. A crank pin 38 integrally extends between the bearing portions 32,32' and has a cylindrical surface 40 extending along and about the axis 42. The circumference of each cylindrical surface 34,34' about the axis 24 is substantially larger than the circumference of the cylindrical surface 40 about the axis 42. This is in contrast to many prior art designs in which the circumference of the crank pin or eccentric drive member is greater than the circumference of the adjacent bearing portion or portions.

In operation, the motor 20 (FIG. 9) rotates the motor shaft 22 and attached crankshaft 28 about the axis 24. This in turn rotates the crank pin 38 about the axis 24 with the axis 42 of the crank pin 38 also moving about the parallel axis 24. The rotating crank pin 38 in FIG. 9 is received within the two, opposing slide pieces 44 of the scotch yoke arrangement 31 (see also FIG. 5). The separate, slide pieces 44,44' (FIG. 5) are confined and mounted by balls 46 to slidingly move relative to the yoke pieces 27,27' along the vertical axis 48. The vertical axis 48 in the orientation of FIG. 5 passes symmetrically through the middle of the yoke member 29. In this manner and as the motor shaft 22 and crankshaft 28 are rotated about the axis 24 (FIG. 9), the offset crank pin 38 and its axis 42 are rotated about the axis 24.

The yoke side pieces 44,44' of FIG. 5 are then moved up and down relative to the axis 48, which motion in turn reciprocally moves the yoke member 29 and attached piston rods 23,23' and piston heads 21,21' along the axis 25. The axes 24 and 42 of FIGS. 9 and 10 in this regard are substantially parallel to one another and substantially perpendicular to the axes 25 and 48 of FIG. 5. In this manner, the scotch yoke arrangement 31 thus translates rotation motion of the driving members 22, 28, and 38 about the axis 24 in FIG. 9 to reciprocal movement of the yoke member 29 and attached piston rods 23,23' and piston heads 21,21' along the axis 25 in FIG. 5.

The slide pieces 44,44' as shown in FIG. 5 abut one another about the crank pin 38 and needle bearing members or pins 50. In this regard, the abutting surfaces 52,52' of the pieces 44,44' are preferably substantially parallel to each other. Additionally, at least one of the surfaces 52,52' in each abutting pair and preferably both surfaces 52,52' have a groove 56 therein (see also FIG. 10). The groove 56 is in fluid communication with the areas 58,58' (FIG. 5) above and below the slide pieces 44,44'. The needle bearings 50 about the crank pin 38 are confined as shown between the semi-cylindrical and inner facing surfaces 60,60' of the pieces 44,44'. In this manner and as the pieces 44,44' slidingly move along the axis 48 relative to the yoke member 29 in FIGS. 4-6, lubricant in the areas 58,58' of FIG. 5 is forced or pumped through the grooves 56 to the needle bearings 50. The yoke housing members 55 in this regard are substantially air tight to keep out dirt. This serves to enhance the pumping action on the lubricant as the volume of the areas 58,58' are contracted. Additionally, the outer surfaces 62,62' of the slide pieces 44,44' adjoining the surfaces 52,52' (see FIG. 6) have depressed or concave portions. These portions form respective pockets 65 as illustrated in FIG. 6 adjacent the entry to each groove 56 to collect lubricant.

The pieces 44,44' of the sliding mechanism as discussed above are mounted to move up and down (in the orientation of FIGS. 5 and 6) along the axis 48 relative to the yoke member 29. The actual motion is along semi-circles extending along each side of axis 48. Although the abutting yoke side pieces 27,27' as seen in FIG. 7 bear any large, opposing forces F,F' that are generated by the pressurized refrigerant and isolate the slide pieces 44,44' from the forces F,F', the movement of the crank pin 38 in FIGS. 4-6 still generates significant forces on the yoke side pieces 27,27'. As for example, the compressor 11 may generate maximum pressures of 550 psi or more in the chambers 49,49' driving the refrigerant out to the tank 4. To ameliorate or dissipate the high forces that can be generated between the driving slide pieces 44,44' and driven yoke side pieces 27,27', a plurality of rows of the balls 46 (FIGS. 6 and 10) are preferably provided. These balls 46 (see FIG. 6) are positioned between the inwardly and outwardly facing surfaces 64,64' of the respective pairs of yoke 27,27' and slide 44,44' pieces (see also FIGS. 9 and 10). Each surface 64,64' preferably has at least two grooves or tracks 66,66' (FIGS. 9 and 10) extending substantially perpendicular to the axis 25 of FIG. 6 with the balls 46 positioned therein. The driving force D of each slide piece 44,44' is then spread over more contact points between the surfaces 64,64' to reduce potential wear and damage. The plurality of balls 46 and tracks 66,66' also helps to maintain the alignment of the driving side pieces 44,44' and driven yoke member 29.

Figure 11:
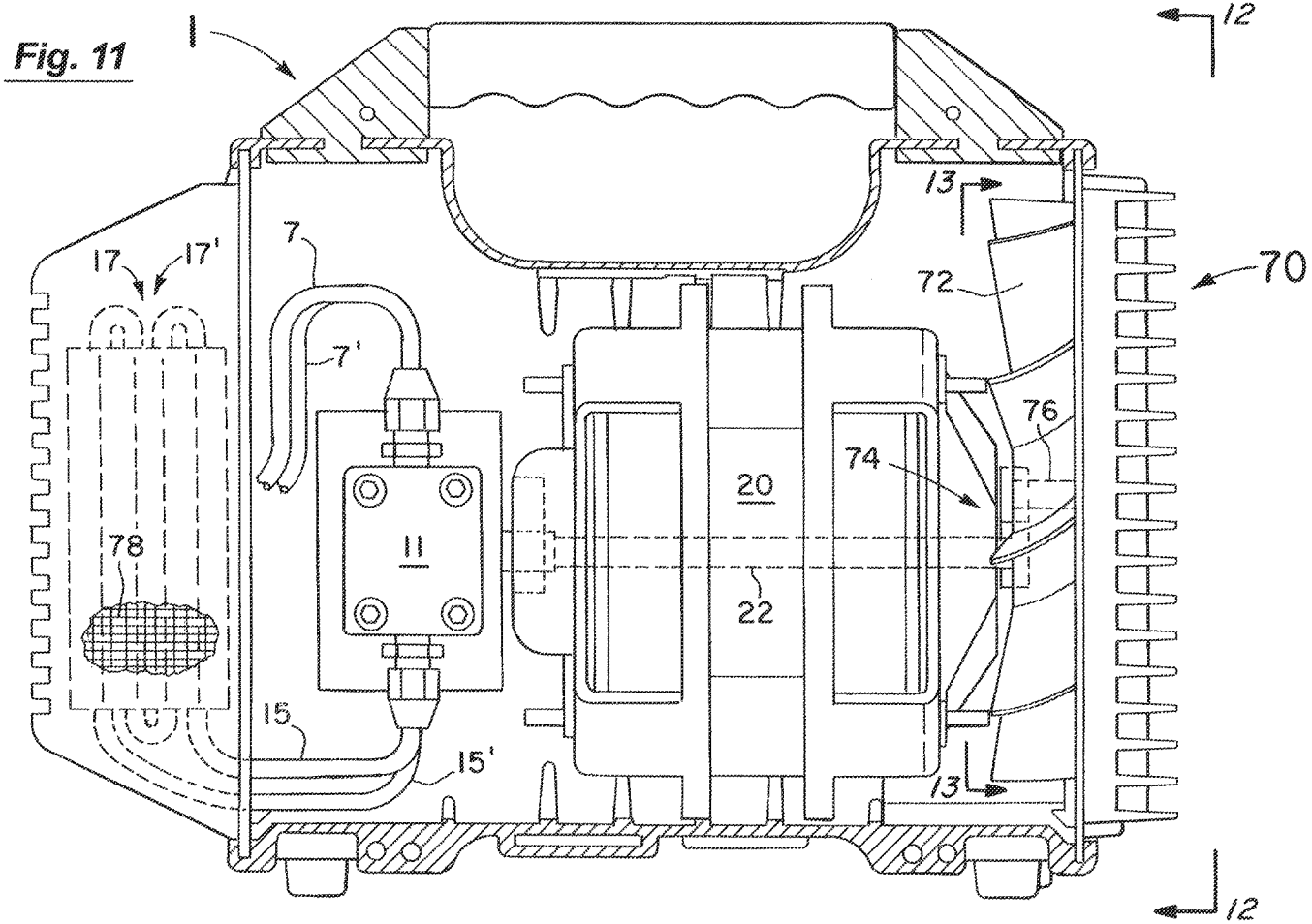
FIG. 11 is a cross-sectional view of the portable recovery unit.
Figure 12:
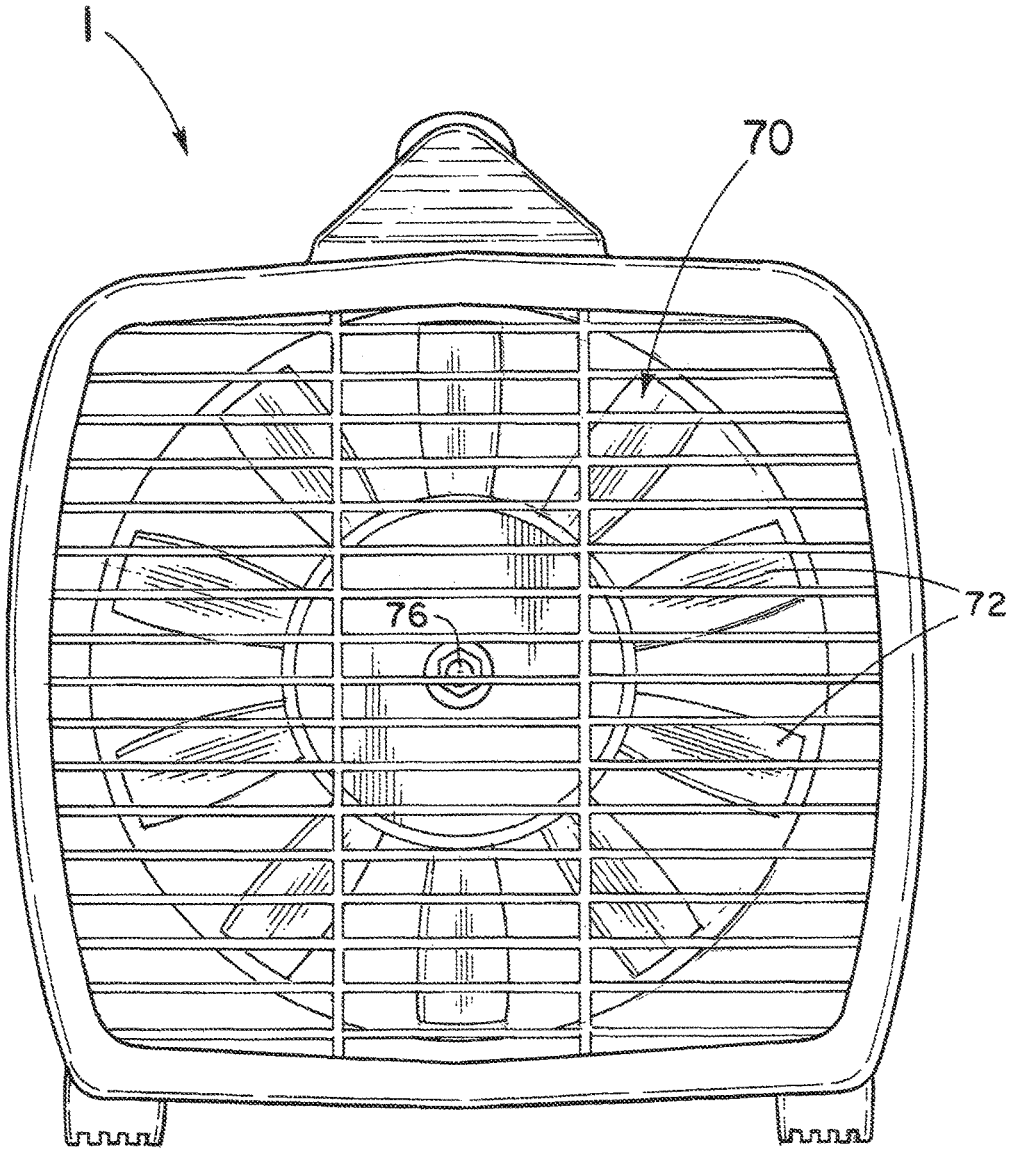
FIG. 12 is a rear view of the recovery unit taken along line 12-12 of FIG. 11 and showing the cooling fan.
Figure 13:
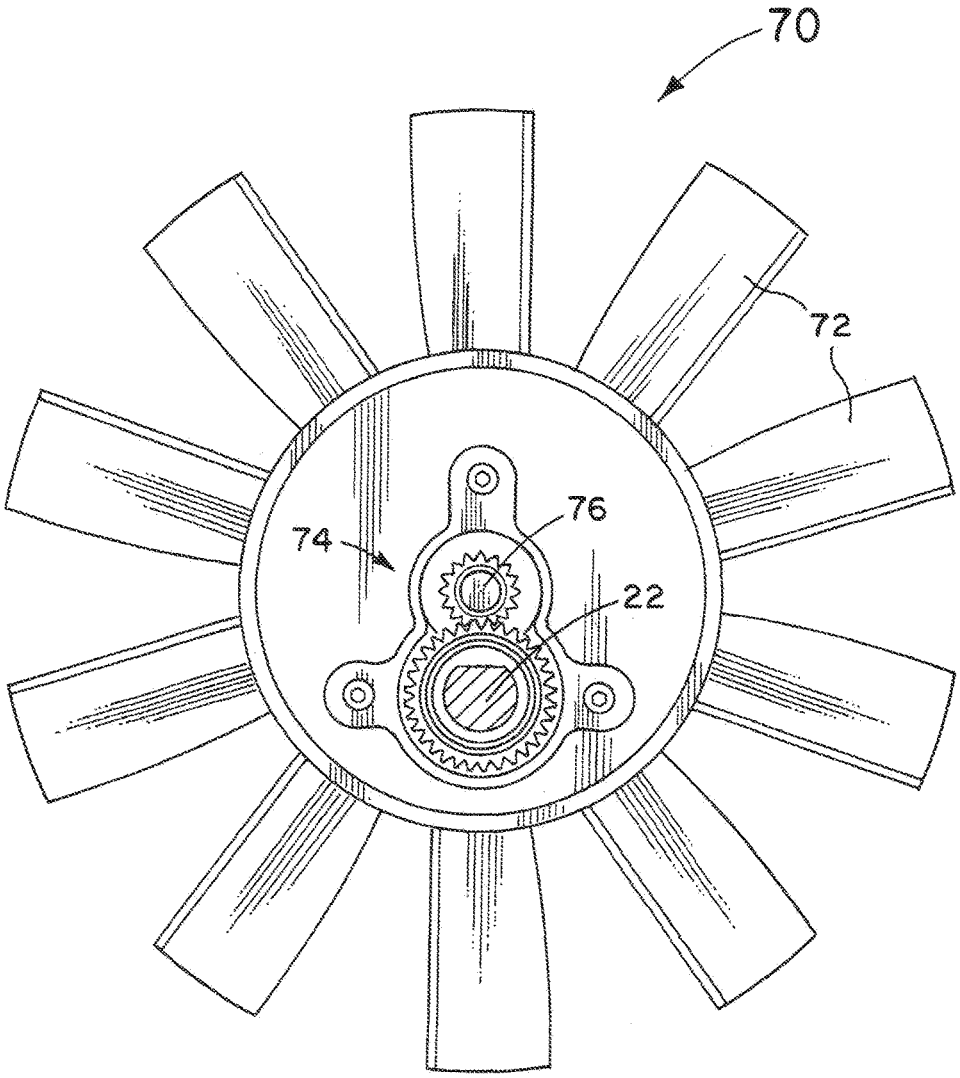
FIG. 13 is a view taken along line 13-13 of FIG. 11 illustrating the step up gearing arrangement for the cooling fan.

The recovery unit 1 preferably includes a cooling fan 70 as illustrated in FIGS. 11-13. The cooling fan 70 has a plurality of relatively large blades 72 (FIGS. 12 and 13) and is driven from the drive shaft 22 of the motor 20 of FIG. 11 through a step up gearing arrangement 74 (FIG. 13). In operation, the drive shaft 22 is driven by the motor 20 (e.g., half horsepower) at a first rate of revolution (e.g., 1700 revolutions per minute) and the step up gearing arrangement 74 rotates the driven shaft 76 of the cooling fan 70 at a substantially greater rate (e.g., 3000 revolutions per minute up to about twice the rate of shaft 22 or more). This creates a relatively large volume of cooling air (e.g., 300 cubic feet per minute) directed through the main body of the unit 1 to cool its parts including the motor 20, compressor 11, and condenser fins 78 (FIG. 11) mounted on the outgoing lines 15,15' containing compressed refrigerant. The step up gearing of the cooling fan 70 is particularly advantageous in the portable unit 1 of the present invention which is often operated outside (e.g., on roof tops) in extremely hot, ambient air temperatures. In such conditions, other units can become quickly overheated and shut down. However, the present unit 1 is specifically designed as discussed above to better handle such extreme conditions. Also, it is specifically noted that the step up gearing arrangement 74 for the cooling fan 70 has applications in other portable units including vacuum pumps for refrigeration systems.

Figure 14:
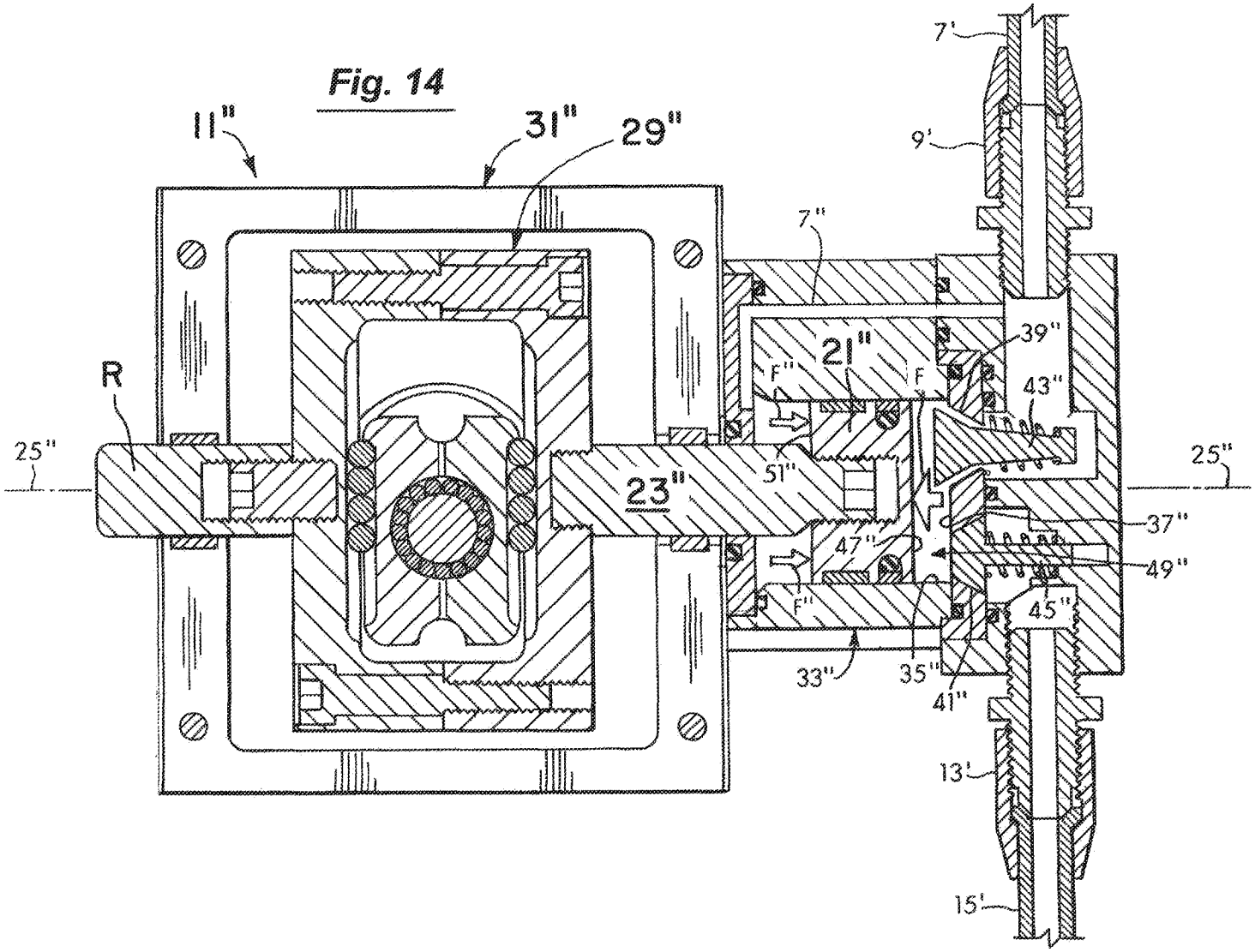
FIG. 14 is a cross-sectional view of a single piston embodiment of the present invention arrangement

In FIG. 14, a single piston embodiment is shown which is driven by essentially the same scotch yoke arrangement 31" as 31 in the earlier embodiments. However, instead of having an opposing, counterbalancing piston, the embodiment of FIG. 14 provides an offsetting force F" on the underside or bottom 51" of the piston head 21". The offsetting force F" is less than the force F on the outer surface 47" of the piston head 21". Nevertheless, the force F" does offer some counteraction along the axis 25" in a direction opposite to the force F, which force F if not offset at least in part might otherwise damage and wear the components of the embodiment of FIG. 14.

To create the offsetting force F", a line 7" is provided to the underside or bottom surface 51" of the piston head 21". The line 7" as shown is in fluid communication with the incoming line 7' and line 6 of FIGS. 2 and 3 from the pressurized refrigerant (e.g., above atmospheric) in the system 2 of FIG. 2. In this manner, the pressure of the pressurized refrigerant in the incoming lines 7' and 7" is the same. The inlet valve 43" and bottom surface 51" of the piston head 21" are then simultaneously and continuously exposed to the same pressure. This remains the case even as the pressure of the incoming, pressurized refrigerant varies over time.

The bottom surface 51" of the piston head 21" adjacent the piston rod 23" extends outwardly of and about the fixed axis 25" as shown in FIG. 14. The difference between the forces F and F" is then the area of the piston rod 23" rigidly attached to the underside or bottom surface 51" of the piston head 21". The stub or rod R on the other side of the yoke member 29" in FIG. 14 is rigidly attached to the yoke member 29" and the movement of the rod R like that of piston rod 23" and piston head 23" is confined to along only the fixed axis 25". This is in a manner corresponding to the earlier, twin embodiments. Similarly, the piston head 21", piston rod 23", and yoke member 29" of FIG. 14 are rigidly attached to one another. Further, the embodiment of FIG. 14 like the earlier embodiments is provided with a corresponding chamber 49" within the cylinder 33" and defined by members 35", 37", and 47". Flow through the single piston compressor 11" in then past the valve 43" in the chamber inlet 39" into the chamber 49" and out the valve 45" in the chamber outlet 43". The operation of the scotch yoke arrangement 31" as indicated above is essentially the same as in the earlier embodiments.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A scotch yoke arrangement (31) having an outer yoke member (29) mounted for reciprocal movement along a first, fixed axis (25) and a slide mechanism mounted within said yoke member (29) on a substantially cylindrical crank pin (38), said crank pin (38) extending substantially symmetrically along and about a second axis (42), said second axis (42) being spaced from and substantially parallel to a third axis (24), said third axis (24) being fixed relative to and substantially perpendicular to said first, fixed axis (25), said crank pin (38) including the second axis (42) thereof being rotatably driven about said third axis (24) wherein said scotch yoke arrangement translates the rotational motion of the crank pin (38) about said third, fixed axis (24) to reciprocally move said yoke member (29) along said first, fixed axis (25), said slide mechanism having first and second portions (44,44') and being mounted for sliding movement along a fourth axis relative to said yoke member (29) with said first and second portions (44,44') moving along said fourth axis substantially perpendicular to said first, fixed axis (25) as said yoke member (29) reciprocally moves along said first, fixed axis (25), said slide mechanism rotatably receiving said crank pin (38) between said first and second portions (44,44') and being moved substantially perpendicular to said first, fixed axis (25) thereby wherein said yoke member (29) has at least two inwardly facing surfaces (64) and each of said first and second portions (44,44') of said slide mechanism has an outwardly facing surface (64') respectively positioned adjacent to one of said inwardly facing surfaces (64) of said yoke member (29), said scotch yoke arrangement further including first bearing members between the respective outwardly facing surfaces (64') of said first and second portions (44,44') and the inwardly facing surfaces (64) of said yoke member wherein adjacent pairs of said inwardly and outwardly facing surfaces (64,64') respectively have at least one groove (66') in the outwardly facing surface (64') extending along said fourth axis and substantially perpendicular to said first, fixed axis (25) with a plurality of said bearing members being positioned between said inwardly and outwardly facing surfaces (64, 64') in said respective one groove (66') and wherein the respective one grooves (66') in the outwardly facing surfaces (64') respectively extend a first distance along said fourth axis and perpendicular to said first, fixed axis (25) and the inwardly facing surfaces (64) respectively extend a second distance along said fourth axis and perpendicular to said first, fixed axis (25) wherein the respective first distance is substantially less than the respective second distance and wherein the bearing members between each of said adjacent pairs of inwardly and outwardly facing surfaces (64,64') are always contained within the respective first distance of the outwardly facing surface (64') in each of said adjacent pairs of inwardly and outwardly facing surfaces (64,64') and do not extend beyond the respective first distances of the outwardly facing surfaces (64') as the first and second portions (44,44') slidingly move relative to the yoke member (29), each respective one groove (66') in the respective outwardly facing surface (64') having a substantially continuous rim portion extending about a fifth axis substantially perpendicular to the fourth axis and a depressed portion extending substantially along said fourth axis away from the rim portion and away from the inwardly facing surface (64) adjacent said respective outwardly facing surface (64').

2. The scotch yoke arrangement of claim 1 wherein the respective inwardly facing surfaces (64) of each of said adjacent pairs of inwardly and outwardly facing surfaces (64,64') has at least a second groove (66) therein facing the one groove (66') of the outwardly facing surface (64') with at least one of said bearing members positioned between the respective one (66') and second (66) grooves of each of said adjacent pairs of inwardly and outwardly facing surfaces (64,64').

3. The scotch yoke arrangement of claim 2 wherein the respective second groove (66) is aligned with the respective one groove (66') in each of said adjacent pairs of inwardly and outwardly facing surfaces (64,64').

4. The scotch yoke arrangement of claim 3 wherein the respective second groove (66) extends substantially perpendicular to the first, fixed axis (25).

5. The scotch yoke arrangement of claim 3 wherein each inwardly and outwardly facing surface (64,64') of each of said adjacent pairs of inwardly and outwardly facing surfaces (64,64') has at least an additional pair of aligned one and second grooves therein to receive bearing members therebetween.

6. The scotch yoke arrangement of claim 1 wherein said slide mechanism is a multi-piece slide mechanism and said first and second portions (44,44') thereof are separate members.

7. The scotch yoke arrangement of claim 1 wherein the respective inwardly facing surfaces (64) of each of said adjacent pairs of inwardly and outwardly facing surfaces (64,64') has at least two grooves with at least one bearing member in each wherein at least one of said two grooves faces the one groove (66') of the outwardly facing surface (64') wherein the at least one bearing member in the one of said two grooves is positioned between the facing grooves.

8. The scotch yoke arrangement of claim 1 wherein said respective one groove (66') is elongated along said fourth axis.

* * * * *